US009114409B2

(12) United States Patent
King et al.

(10) Patent No.: US 9,114,409 B2
(45) Date of Patent: Aug. 25, 2015

(54) MECHANICALLY INTEGRATED AND CLOSELY COUPLED PRINT HEAD AND MIST SOURCE

(71) Applicant: Optomec, Inc., Albuquerque, NM (US)

(72) Inventors: Bruce H. King, Albuquerque, NM (US); Gregory James Marquez, Albuquerque, NM (US); Michael J. Renn, Hudson, WI (US)

(73) Assignee: Optomec, Inc., Albuquerque, NM (US)

( * ) Notice: Subject to any disclaimer, the term of this patent is extended or adjusted under 35 U.S.C. 154(b) by 0 days.

(21) Appl. No.: 13/626,708

(22) Filed: Sep. 25, 2012

(65) Prior Publication Data

US 2013/0029032 A1 Jan. 31, 2013

Related U.S. Application Data

(62) Division of application No. 12/203,037, filed on Sep. 2, 2008, now Pat. No. 8,272,579.

(60) Provisional application No. 60/969,068, filed on Aug. 30, 2007.

(51) Int. Cl.
*F23D 11/16* (2006.01)
*B05B 7/00* (2006.01)
(Continued)

(52) U.S. Cl.
CPC ..... *B05B 7/0012* (2013.01); *B01L 3/0268* (2013.01); *B05B 7/0458* (2013.01); *B41J 2/04* (2013.01); *B01L 2200/0636* (2013.01); *B01L 2200/0652* (2013.01); *B01L 2300/0819* (2013.01);
(Continued)

(58) Field of Classification Search
CPC .. B05B 3/1092; B05B 5/0426; B05B 7/2435; B05B 7/0416; B05B 7/0441
USPC ..... 239/290, 291, 424, 428, 416.4, 416.5, 239/418, 590.5, 8, 419, 419.3, 419.5, 422, 239/423
See application file for complete search history.

(56) References Cited

U.S. PATENT DOCUMENTS 3,474,971 A 10/1969 Goodrich
3,590,477 A 7/1971 Cheroff et al.
(Continued)

FOREIGN PATENT DOCUMENTS

CN 2078199 6/1991
CN 1452554 10/2003
(Continued)

OTHER PUBLICATIONS

Webster's Ninth New Collegiate Dictionary, Merriam-Webster, Inc., Springifled, MA. USA, 1990, 744.
(Continued)

*Primary Examiner* — Davis Hwu
(74) *Attorney, Agent, or Firm* — Philip D. Askenazy; Peacock Myers, P.C.

(57) ABSTRACT

A deposition apparatus comprising one or more atomizers structurally integrated with a deposition head. The entire head may be replaceable, and prefilled with material. The deposition head may comprise multiple nozzles. Also an apparatus for three dimensional materials deposition comprising a tiltable deposition head attached to a non-tiltable atomizer. Also methods and apparatuses for depositing different materials either simultaneously or sequentially.

23 Claims, 7 Drawing Sheets

(51) Int. Cl.

| | |
|---|---|
| ***B01L 3/02*** | (2006.01) |
| ***B41J 2/04*** | (2006.01) |
| *B05B 7/04* | (2006.01) |
| *B05B 7/12* | (2006.01) |
| *B05B 7/16* | (2006.01) |
| *B05B 15/04* | (2006.01) |
| *B05B 17/06* | (2006.01) |

(52) U.S. Cl.
CPC .. *B01L2400/0439* (2013.01); *B01L 2400/0487* (2013.01); *B05B 7/0408* (2013.01); *B05B 7/0475* (2013.01); *B05B 7/12* (2013.01); *B05B 7/16* (2013.01); *B05B 15/0431* (2013.01); *B05B 17/0615* (2013.01)

(56) References Cited

U.S. PATENT DOCUMENTS 3,642,202 A 2/1972 Angelo
3,715,785 A 2/1973 Brown et al.
3,777,983 A * 12/1973 Hibbins ..... 239/422
3,808,432 A 4/1974 Ashkin
3,808,550 A 4/1974 Ashkin
3,816,025 A 6/1974 O'Neill
3,846,661 A 11/1974 Brown et al.
3,854,321 A 12/1974 Dahneke
3,901,798 A 8/1975 Peterson
3,959,798 A 5/1976 Hochberg et al.
3,974,769 A 8/1976 Hochberg et al.
3,982,251 A 9/1976 Hochberg
4,004,733 A 1/1977 Law
4,016,417 A 4/1977 Benton
4,019,188 A 4/1977 Hochberg
4,034,025 A 7/1977 Martner
4,036,434 A * 7/1977 Anderson et al. ..... 239/8
4,046,073 A 9/1977 Mitchell et al.
4,046,074 A 9/1977 Hochberg et al.
4,073,436 A * 2/1978 Behr ..... 239/8
4,092,535 A 5/1978 Ashkin et al.
4,112,437 A 9/1978 Mir et al.
4,132,894 A 1/1979 Yule
4,171,096 A 10/1979 Welsh et al.
4,200,660 A 4/1980 Schaefer et al.
4,200,669 A 4/1980 Schaefer et al.
4,228,440 A 10/1980 Horike et al.
4,235,563 A 11/1980 Hine et al.
4,269,868 A 5/1981 Livsey
4,323,756 A 4/1982 Brown et al.
4,400,408 A 8/1983 Asano et al.
4,453,803 A 6/1984 Hidaka et al.
4,485,387 A 11/1984 Drumheller
4,497,692 A 2/1985 Gelchinski et al.
4,601,921 A 7/1986 Lee
4,605,574 A 8/1986 Yonehara et al.
4,670,135 A 6/1987 Marple et al.
4,685,563 A 8/1987 Cohen et al.
4,689,052 A 8/1987 Ogren et al.
4,694,136 A 9/1987 Kasner et al.
4,724,299 A 2/1988 Hammeke
4,733,018 A 3/1988 Prabhu et al.
4,823,009 A 4/1989 Biemann et al.
4,825,299 A 4/1989 Okada et al.
4,826,583 A 5/1989 Biernaux et al.
4,893,886 A 1/1990 Ashkin et al.
4,904,621 A 2/1990 Loewenstein et al.
4,911,365 A 3/1990 Thiel et al.
4,917,830 A 4/1990 Ortiz et al.
4,920,254 A 4/1990 DeCamp et al.
4,927,992 A 5/1990 Whitlow et al.
4,947,463 A 8/1990 Matsuda et al.
4,971,251 A 11/1990 Dobrick et al.
4,978,067 A 12/1990 Berger et al.
4,997,809 A 3/1991 Gupta
5,032,850 A 7/1991 Andeen et al.
5,038,014 A 8/1991 Pratt et al.
5,043,548 A 8/1991 Whitney et al.
5,064,685 A 11/1991 Kestenbaum et al.
5,126,102 A 6/1992 Takahashi et al.
5,164,535 A 11/1992 Leasure
5,170,890 A 12/1992 Wilson et al.
5,173,220 A 12/1992 Reiff et al.
5,176,328 A 1/1993 Alexander
5,176,744 A 1/1993 Muller
5,182,430 A 1/1993 Lagain
5,194,297 A 3/1993 Scheer et al.
5,208,431 A 5/1993 Uchiyama et al.
5,245,404 A 9/1993 Jannson et al.
5,250,383 A 10/1993 Naruse
5,254,832 A 10/1993 Gartner et al.
5,270,542 A 12/1993 McMurry et al.
5,292,418 A 3/1994 Morita et al.
5,294,459 A 3/1994 Hogan et al.
5,306,447 A 4/1994 Harris et al.
5,322,221 A 6/1994 Anderson
5,335,000 A 8/1994 Stevens
5,343,434 A 8/1994 Noguchi
5,344,676 A 9/1994 Kim et al.
5,359,172 A 10/1994 Kozak et al.
5,366,559 A 11/1994 Periasamy
5,378,505 A 1/1995 Kubota et al.
5,378,508 A 1/1995 Castro et al.
5,393,613 A 2/1995 MacKay
5,398,193 A 3/1995 deAngelis
5,403,617 A 4/1995 Haaland
5,405,660 A 4/1995 Psiuk et al.
5,418,350 A 5/1995 Freneaux et al.
5,449,536 A 9/1995 Funkhouser
5,477,026 A 12/1995 Buongiorno
5,486,676 A 1/1996 Aleshin
5,491,317 A 2/1996 Pirl
5,495,105 A 2/1996 Nishimura et al.
5,512,745 A 4/1996 Finer et al.
5,518,680 A 5/1996 Cima et al.
5,524,828 A 6/1996 Raterman et al.
5,529,634 A 6/1996 Miyata et al.
5,547,094 A 8/1996 Bartels et al.
5,578,227 A 11/1996 Rabinovich
5,607,730 A 3/1997 Ranalli
5,609,921 A 3/1997 Gitzhofer et al.
5,612,099 A 3/1997 Thaler
5,614,252 A 3/1997 McMillan et al.
5,648,127 A 7/1997 Turchan et al.
5,653,925 A 8/1997 Batchelder
5,676,719 A 10/1997 Stavropoulos et al.
5,697,046 A 12/1997 Conley
5,705,117 A 1/1998 O'Connor et al.
5,707,715 A 1/1998 deRochemont et al.
5,732,885 A 3/1998 Huffman
5,733,609 A 3/1998 Wang
5,736,195 A 4/1998 Haaland
5,742,050 A 4/1998 Amirav et al.
5,746,844 A 5/1998 Sterett et al.
5,770,272 A 6/1998 Biemann et al.
5,772,106 A 6/1998 Ayers et al.
5,772,963 A 6/1998 Prevost et al.
5,772,964 A 6/1998 Prevost et al.
5,775,402 A 7/1998 Sachs et al.
5,779,833 A 7/1998 Cawley et al.
5,795,388 A 8/1998 Oudard
5,814,152 A 9/1998 Thaler
5,837,960 A 11/1998 Lewis et al.
5,844,192 A 12/1998 Wright et al.
5,847,357 A 12/1998 Woodmansee et al.
5,849,238 A 12/1998 Schmidt et al.
5,854,311 A 12/1998 Richart
5,861,136 A 1/1999 Glicksman et al.
5,882,722 A 3/1999 Kydd
5,894,403 A 4/1999 Shah et al.
5,940,099 A 8/1999 Karlinski
5,958,268 A 9/1999 Engelsberg et al.
5,965,212 A 10/1999 Dobson et al.
5,980,998 A 11/1999 Sharma et al.
5,993,549 A 11/1999 Kindler et al.
5,993,554 A 11/1999 Keicher et al.

(56) References Cited

U.S. PATENT DOCUMENTS 5,997,956 A 12/1999 Hunt et al.
6,007,631 A 12/1999 Prentice et al.
6,015,083 A 1/2000 Hayes et al.
6,021,776 A 2/2000 Allred et al.
6,025,037 A 2/2000 Wadman et al.
6,036,889 A 3/2000 Kydd
6,040,016 A 3/2000 Mitani et al.
6,046,426 A 4/2000 Jeantette et al.
6,056,994 A 5/2000 Paz de Araujo et al.
6,110,144 A 8/2000 Choh et al.
6,116,718 A 9/2000 Peeters et al.
6,136,442 A 10/2000 Wong
6,143,116 A 11/2000 Hayashi et al.
6,144,008 A 11/2000 Rabinovich
6,149,076 A 11/2000 Riney
6,151,435 A 11/2000 Pilloff
6,159,749 A 12/2000 Liu
6,176,647 B1 1/2001 Itoh
6,182,688 B1 2/2001 Fabre
6,183,690 B1 2/2001 Yoo et al.
6,197,366 B1 3/2001 Takamatsu
6,251,488 B1 6/2001 Miller et al.
6,258,733 B1 7/2001 Solayappan et al.
6,265,050 B1 7/2001 Wong et al.
6,267,301 B1 7/2001 Haruch
6,268,584 B1 7/2001 Keicher et al.
6,290,342 B1 9/2001 Vo et al.
6,291,088 B1 9/2001 Wong
6,293,659 B1 9/2001 Floyd et al.
6,318,642 B1 11/2001 Goenka et al.
6,328,026 B1 12/2001 Wang et al.
6,340,216 B1 1/2002 Peeters et al.
6,348,687 B1 2/2002 Brockmann et al.
6,349,668 B1 2/2002 Sun et al.
6,355,533 B2 3/2002 Lee
6,379,745 B1 4/2002 Kydd et al.
6,384,365 B1 5/2002 Seth et al.
6,390,115 B1 5/2002 Rohwer et al.
6,391,251 B1 5/2002 Keicher et al.
6,391,494 B2 5/2002 Reitz et al.
6,405,095 B1 6/2002 Jang et al.
6,406,137 B1 6/2002 Okazaki et al.
6,410,105 B1 6/2002 Mazumder et al.
6,416,156 B1 7/2002 Noolandi et al.
6,416,157 B1 7/2002 Peeters et al.
6,416,158 B1 7/2002 Floyd et al.
6,416,159 B1 7/2002 Floyd et al.
6,416,389 B1 7/2002 Perry et al.
6,454,384 B1 9/2002 Peeters et al.
6,467,862 B1 10/2002 Peeters et al.
6,471,327 B2 10/2002 Jagannathan et al.
6,481,074 B1 11/2002 Karlinski
6,486,432 B1 11/2002 Colby et al.
6,503,831 B2 1/2003 Speakman
6,513,736 B1 2/2003 Skeath et al.
6,520,996 B1 2/2003 Manasas et al.
6,521,297 B2 2/2003 McDougall et al.
6,537,501 B1 3/2003 Holl et al.
6,544,599 B1 4/2003 Brown et al.
6,548,122 B1 4/2003 Sharma et al.
6,564,038 B1 5/2003 Bethea et al.
6,572,033 B1 6/2003 Pullagura et al.
6,573,491 B1 6/2003 Marchitto et al.
6,607,597 B2 8/2003 James et al.
6,608,281 B2 8/2003 Ishide et al.
6,636,676 B1 10/2003 Renn
6,646,253 B1 11/2003 Rohwer et al.
6,656,409 B1 12/2003 Keicher et al.
6,772,649 B2 8/2004 Zimmermann et al.
6,774,338 B2 8/2004 Baker et al.
6,780,377 B2 8/2004 Hall et al.
6,811,744 B2 11/2004 Keicher et al.
6,811,805 B2 11/2004 Gilliard et al.
6,823,124 B1 11/2004 Renn et al.
6,855,631 B2 2/2005 Kirby
6,890,624 B1 5/2005 Kambe et al.
6,921,626 B2 7/2005 Ray et al.
6,998,345 B2 2/2006 Kirby
6,998,785 B1 2/2006 Silfvast et al.
7,009,137 B2 3/2006 Guo et al.
7,045,015 B2 5/2006 Renn et al.
7,108,894 B2 9/2006 Renn
7,178,380 B2 2/2007 Shekarriz et al.
7,270,844 B2 9/2007 Renn
7,294,366 B2 11/2007 Renn et al.
7,485,345 B2 2/2009 Renn et al.
7,658,163 B2 2/2010 Renn et al.
7,674,671 B2 3/2010 Renn et al.
7,836,922 B2 11/2010 Poole et al.
8,012,235 B2 9/2011 Takashima et al.
2001/0046551 A1 11/2001 Falck et al.
2002/0012743 A1 1/2002 Sampath et al.
2002/0063117 A1 5/2002 Church et al.
2002/0071934 A1 6/2002 Marutsuka
2002/0082741 A1 6/2002 Mazumder et al.
2002/0096647 A1 7/2002 Moors et al.
2002/0100416 A1 8/2002 Sun et al.
2002/0128714 A1 9/2002 Manasas et al.
2002/0132051 A1 9/2002 Choy
2002/0162974 A1 11/2002 Orsini et al.
2003/0003241 A1 1/2003 Suzuki et al.
2003/0020768 A1 1/2003 Renn
2003/0048314 A1 3/2003 Renn
2003/0108511 A1 6/2003 Sawhney
2003/0108664 A1 6/2003 Kodas et al.
2003/0117691 A1 6/2003 Bi et al.
2003/0138967 A1 7/2003 Hall et al.
2003/0175411 A1 9/2003 Kodas et al.
2003/0180451 A1 9/2003 Kodas et al.
2003/0202043 A1 10/2003 Moffat et al.
2003/0219923 A1 11/2003 Nathan et al.
2003/0228124 A1 12/2003 Renn et al.
2004/0004209 A1 1/2004 Matsuba et al.
2004/0029706 A1 2/2004 Barrera et al.
2004/0038808 A1 2/2004 Hampden-Smith et al.
2004/0080917 A1 4/2004 Steddom et al.
2004/0151978 A1 8/2004 Huang
2004/0179808 A1 9/2004 Renn
2004/0185388 A1 9/2004 Hirai
2004/0191695 A1 9/2004 Ray et al.
2004/0197493 A1 10/2004 Renn et al.
2004/0227227 A1 11/2004 Imanaka et al.
2004/0247782 A1 12/2004 Hampden-Smith et al.
2005/0002818 A1 1/2005 Ichikawa
2005/0097987 A1 5/2005 Kodas et al.
2005/0101129 A1 5/2005 Lirby
2005/0110064 A1 5/2005 Duan et al.
2005/0129383 A1 6/2005 Renn et al.
2005/0133527 A1 6/2005 Dullea et al.
2005/0145968 A1 7/2005 Goela et al.
2005/0147749 A1 7/2005 Liu et al.
2005/0156991 A1 7/2005 Renn
2005/0163917 A1 7/2005 Renn
2005/0184328 A1 8/2005 Uchiyama et al.
2005/0205415 A1 9/2005 Belousov et al.
2005/0205696 A1 9/2005 Saito et al.
2005/0214480 A1 9/2005 Garbar et al.
2005/0215689 A1 9/2005 Garbar et al.
2005/0238804 A1 10/2005 Garbar et al.
2005/0247681 A1 11/2005 Boillot et al.
2006/0003095 A1 1/2006 Bullen et al.
2006/0008590 A1 1/2006 King et al.
2006/0035033 A1 2/2006 Tanahashi
2006/0043598 A1 3/2006 Kirby et al.
2006/0046347 A1 3/2006 Wood et al.
2006/0046461 A1 3/2006 Benson et al.
2006/0057014 A1 3/2006 Oda et al.
2006/0162424 A1 7/2006 Shekarriz et al.
2006/0163570 A1 7/2006 Renn et al.
2006/0163744 A1 7/2006 Vanheusden et al.
2006/0172073 A1 8/2006 Groza et al.
2006/0175431 A1 8/2006 Renn et al.
2006/0233953 A1 10/2006 Renn et al.
2006/0280866 A1 12/2006 Marquez et al.

(56) References Cited

U.S. PATENT DOCUMENTS

| | | | |
|---|---|---|---|
| 2007/0019028 | A1 | 1/2007 | Renn |
| 2007/0128905 | A1 | 6/2007 | Speakman |
| 2007/0154634 | A1 | 7/2007 | Renn |
| 2007/0181060 | A1 | 8/2007 | Renn et al. |
| 2008/0013299 | A1 | 1/2008 | Renn |
| 2009/0061089 | A1 | 3/2009 | King et al. |
| 2009/0114151 | A1 | 5/2009 | Renn et al. |
| 2009/0229412 | A1 | 9/2009 | Takashima et al. |
| 2010/0112234 | A1 | 5/2010 | Spatz et al. |
| 2010/0173088 | A1 | 7/2010 | King |
| 2010/0192847 | A1 | 8/2010 | Renn et al. |
| 2010/0255209 | A1 | 10/2010 | Renn et al. |
| 2011/0129615 | A1 | 6/2011 | Renn et al. |

FOREIGN PATENT DOCUMENTS

| | | | |
|---|---|---|---|
| DE | 198 41 401 | | 4/2000 |
| EP | 0 331 022 | A2 | 9/1989 |
| EP | 0 444 550 | A2 | 9/1991 |
| EP | 0470911 | | 7/1994 |
| EP | 1 258 293 | | 11/2002 |
| JP | 2001-507449 | | 6/2001 |
| JP | 2002539924 | | 11/2002 |
| JP | 3425522 | | 7/2003 |
| JP | 2007-507114 | | 3/2007 |
| KR | 20000013770 | | 3/2000 |
| KR | 1002846070000 | | 8/2001 |
| KR | 10-2007-0008614 | | 1/2007 |
| KR | 10-2007-0008621 | | 1/2007 |
| WO | WO9633797 | | 10/1996 |
| WO | WO 00/23825 | | 4/2000 |
| WO | WO 00/69235 | | 11/2000 |
| WO | 01/83101 | A1 | 11/2001 |
| WO | WO 2006/041657 | A2 | 4/2006 |
| WO | WO 2006/065978 | A2 | 6/2006 |

OTHER PUBLICATIONS

Ashkin, A , "Acceleration and Trapping of Particles by Radiation Pressure", Physical Review Letters, Jan. 26, 1970, 156-159.
Ashkin, A. , "Optical trapping and manipulation of single cells using infrared laser beams", Nature, Dec. 1987, 769-771.
Dykhuizen, R. C. , "Impact of High Velocity Cold Spray Particles", May 13, 2000, 1-18.
Fernandez De La Mora, J. et al., "Aerodynamic focusing of particles in a carrier gas", J. Fluid Mech., vol. 195, printed in Great Britain, 1988, 1-21.
King, Bruce et al., "M3D TM Technology: Maskless Mesoscale TM Materials Deposition", Optomec pamphlet, 2001.
Lewandowski, H. J. et al., "Laser Guiding of Microscopic Particles in Hollow Optical Fibers", Announcer 27, Summer Meeting—Invited and Contributed Abstracts, Jul. 1997, 89.
Marple, V. A. et al., "Inertial, Gravitational, Centrifugal, and Thermal Collection Techniques", Aerosol Measurement: Principles, Techniques and Applications, 2001, 229-260.
Miller, Doyle et al., "Maskless Mesoscale Materials Deposition", HDI, vol. 4, No. 9, Sep. 2001, 1-3.
Odde, D. J. et al., "Laser-Based Guidance of Cells Through Hollow Optical Fibers", The American Society for Cell Biology Thirty-Seventh Annual Meeting, Dec. 17, 1997.
Odde, D. J. et al., "Laser-guided direct writing for applications in biotechnology", Trends in Biotechnology, Oct. 1999, 385-389.
Rao, N. P. et al., "Aerodynamic Focusing of Particles in Viscous Jets", J. Aerosol Sci., vol. 24, No. 7, Pergamon Press, Ltd., Great Britain, 1993, 879-892.
Renn, M. J. et al., "Evanescent-wave guiding of atoms in hollow optical fibers", Physical Review A, Feb. 1996, R648-R651.
Renn, M. J. et al., "Laser-Guidance and Trapping of Mesoscale Particles in Hollow-Core Optical Fibers", Physical Review Letters, Feb. 15, 1999, 1574-1577.
Renn, M. J. et al., "Laser-Guided Atoms in Hollow-Core Optical Fibers", Physical Review Letters, Oct. 30, 1995, 3253-3256.
Renn, M. J. et al., "Optical-dipole-force fiber guiding and heating of atoms", Physical Review A, May 1997, 3684-3696.
Renn, M. J. et al., "Particle Manipulation and Surface Patterning by Laser Guidance", Submitted to EIPBN '98, Session AM4, 1998.
Renn, M. J. et al., "Particle manipulation and surface patterning by laser guidance", Journal of Vacuum Science & Technology B, Nov./Dec. 1998, 3859-3863.
Renn, Michael J. et al., "Flow- and Laser-Guided Direct Write of Electronic and Biological Components", Direct-Write Technologies for Rapid Prototyping Applications, Academic Press, 2002, 475-492.
Sobeck, et al., "Technical Digest: 1994 Solid-State Sensor and Actuator Workshop", 1994, 647.
TSI Incorporated, , "How A Virtual Impactor Works", www.tsi.com, Sep. 21, 2001.
Vanheusden, K. et al., "Direct Printing of Interconnect Materials for Organic Electronics", IMAPS ATW, Printing an Intelligent Future, Mar. 8-10, 2002, 1-5.
Zhang, Xuefeng et al., "A Numerical Characterization of Particle Beam Collimation by an Aerodynamic Lens-Nozzle System: Part I. An Individual Lens or Nozzle", Aerosol Science and Technology, vol. 36, Taylor and Francis, 2002, 617-631.

* cited by examiner

MECHANICALLY INTEGRATED AND CLOSELY COUPLED PRINT HEAD AND MIST SOURCE

CROSS-REFERENCE TO RELATED APPLICATIONS

This Application is a divisional application of U.S. patent application Ser. No. 12/203,037, entitled "Mechanically Integrated and Closely Coupled Print Head and Mist Source", filed on Sep. 2, 2008 and issuing as U.S. Pat. No. 8,272,579 on Sep. 25, 2012, which application claims the benefit of the filing of U.S. Provisional Patent Application Ser. No. 60/969,068, entitled "Mechanically Integrated and Closely Coupled Print Head and Mist Source", filed on Aug. 30, 2007, the specification of which is incorporated herein by reference.

BACKGROUND OF THE INVENTION

Field of the Invention (Technical Field)

The present invention is an apparatus comprising an atomizer located within or adjacent to a deposition head used to directly deposit material onto planar or non-planar targets.

BRIEF SUMMARY OF THE INVENTION

The present invention is a deposition head for depositing a material, the deposition head comprising one or more carrier gas inlets, one or more atomizers, an aerosol manifold structurally integrated with the one or more atomizers, one or more aerosol delivery conduits in fluid connection with the aerosol manifold, a sheath gas inlet and one or more material deposition outlets. The deposition head preferably further comprises a virtual impactor and an exhaust gas outlet, the virtual impactor disposed between at least one of the one or more atomizers and the aerosol manifold. The deposition head preferably further comprises a reservoir of material, and optionally a drain for transporting unused material from the aerosol manifold back into the reservoir. The deposition head optionally further comprises an external reservoir of material useful for a purpose selected from the group consisting of enabling a longer period of operation without refilling, maintaining the material at a desired temperature, maintaining the material at a desired viscosity, maintaining the material at a desired composition, and preventing agglomeration of particulates. The deposition head preferably further comprises a sheath gas manifold concentrically surrounding at least a middle portion of the one or more aerosol delivery conduits. The deposition head optionally further comprises a sheath gas chamber surrounding a portion of each aerosol delivery conduit comprising a conduit outlet, the aerosol delivery conduit preferably being sufficiently long so the sheath gas flow is substantially parallel to the aerosol flow before the flows combine at or near an outlet of the sheath gas chamber after the aerosol flow exits the conduit outlet. The deposition head is optionally replaceable and comprises a material reservoir prefilled with material before installation. Such a deposition head is optionally disposable or refillable. Each of the one or more atomizers optionally atomizes different materials, which preferably do not mix and/or react until just before or during deposition. The ratio of the different materials to be deposited is preferably controllable. The atomizers are optionally operated simultaneously, or at least two of the atomizers are optionally operated at different times.

The present invention is also an apparatus for three-dimensional material deposition, the apparatus comprising a deposition head and an atomizer, wherein the deposition head and atomizer travel together in three linear dimensions, and wherein the deposition head is tiltable but the atomizer is not tiltable. The apparatus is preferably useful for depositing the material on the exterior, interior, and/or underside of a structure and is preferably configured so that the deposition head is extendible into a narrow passage.

The present invention is also a method for depositing materials comprising the steps of atomizing a first material to form a first aerosol, atomizing a second material to form a second aerosol, combining the first aerosol and second aerosol, surrounding the combined aerosols with an annular flow of a sheath gas, focusing the combined aerosols, and depositing the aerosols. The atomizing steps are optionally performed simultaneously or sequentially. The method optionally further comprises the step of varying the amount of material in at least one of the aerosols. The atomizing steps optionally comprise using atomizers of a different design. The method optionally further comprises the step of depositing a composite structure.

An advantage of the present invention is improved deposition due to reduced droplet evaporation and reduced overspray.

Another advantage to the present invention is a reduction in the delay between the initiation of gas flow and deposition of material onto a target.

Objects, other advantages and novel features, and further scope of applicability of the present invention will be set forth in part in the detailed description to follow, taken in conjunction with the accompanying drawing, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
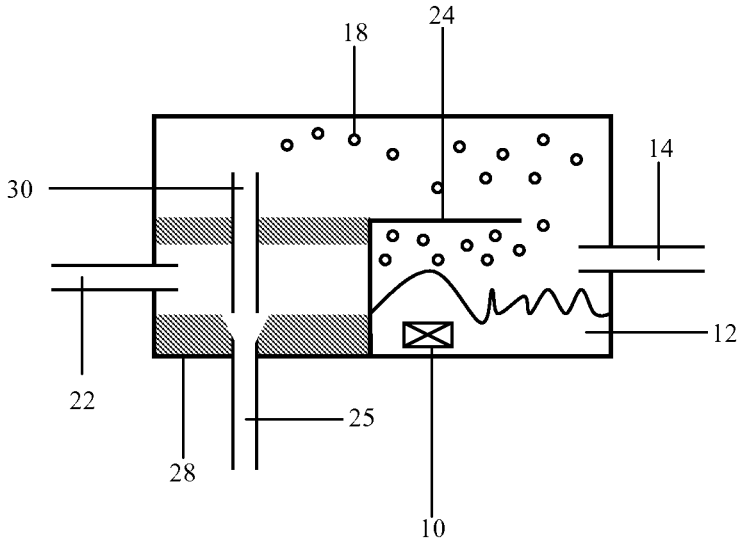
FIG. 1 is a schematic of an apparatus of the present invention for gradient material fabrication.

The present invention generally relates to apparatuses and methods for high-resolution, maskless deposition of liquids, solutions, and liquid-particle suspensions using aerodynamic focusing. In one embodiment, an aerosol stream is focused and deposited onto a planar or non-planar target, forming a pattern that is thermally or photochemically processed to achieve physical, optical, and/or electrical properties near that of the corresponding bulk material. The process is called $M^3D$® (Maskless Mesoscale Material Deposition) technology, and is used to deposit, preferably directly and without the use of masks, aerosolized materials with linewidths that are orders of magnitude smaller than lines deposited with conventional thick film processes, even smaller than one micron.

The $M^3D$® apparatus preferably comprises an aerosol jet deposition head to form an annularly propagating jet composed of an outer sheath flow and an inner aerosol-laden carrier flow. In the annular aerosol jetting process, the aerosol stream typically enters the deposition head, preferably either directly after the aerosolization process or after passing through a heater assembly, and is directed along the axis of the device towards the deposition head orifice. The mass throughput is preferably controlled by an aerosol carrier gas mass flow controller. Inside the deposition head, the aerosol stream is preferably initially collimated by passing through an orifice, typically millimeter-sized. The emergent particle stream is then preferably combined with an annular sheath gas, which functions to eliminate clogging of the nozzle and to focus the aerosol stream. The carrier gas and the sheath gas most commonly comprise compressed air or an inert gas, where one or both may contain a modified solvent vapor content. For example, when the aerosol is formed from an aqueous solution, water vapor may be added to the carrier gas or the sheath gas to prevent droplet evaporation.

The sheath gas preferably enters through a sheath air inlet below the aerosol inlet and forms an annular flow with the aerosol stream. As with the aerosol carrier gas, the sheath gas flowrate is preferably controlled by a mass flow controller. The combined streams exit the nozzle at a high velocity (~50 m/s) through an orifice directed at a target, and subsequently impinge upon it. This annular flow focuses the aerosol stream onto the target and allows for deposition of features with dimensions smaller than approximately 1 micron. Patterns are formed by moving the deposition head relative to the target.

Atomizer Located Adjacent to the Deposition Head

The atomizer is typically connected to the deposition head through the mist delivery means, but is not mechanically coupled to the deposition head. In one embodiment of the present invention, the atomizer and deposition head are fully integrated, sharing common structural elements.

As used throughout the specification and claims, the term "atomizer" means atomizer, nebulizer, transducer, plunger, or any other device, activated in any way including but not limited to pneumatically, ultrasonically, mechanically, or via a spray process, which is used to form smaller droplets or particles from a liquid or other material, or condense particles from a vapor, typically for suspension into an aerosol.

If the atomizer is adjacent to or integrated with the deposition head, the length of tubing required to transport the mist between the atomizer and the head is reduced or eliminated. Correspondingly, the transit time of mist in the tube is substantially reduced, minimizing solvent loss from the droplets during transport. This in turn reduces overspray and allows the use of more volatile liquids than could ordinarily be used. Further, particle losses inside the delivery tube are minimized or eliminated, improving the overall efficiency of the deposition system and reducing the incidence of clogging. The response time of the system is also significantly improved.

Further advantages relate to the use of the closely coupled head in constructing systems for manufacturing. For small substrates, automation is simplified by fixing the atomizer and deposition head and moving the substrate. In this case there are many placement options for the atomizer relative to the deposition head. However, for large substrates, such as those encountered in the manufacturing of flat panel displays, the situation is reversed and it is simpler to move the deposition head. In this case the placement options for the atomizer are more limited. Long lengths of tubing are typically required to deliver mist from a stationary atomizer to a head mounted on a moving gantry. Mist losses due to coalescence can be severe and solvent loss due to the long residence time can dry the mist to the point where it is no longer usable.

Another advantage arises in the construction of a cartridge-style atomizer and deposition head. In this configuration, the atomizer and deposition head are coupled in such a way that they may be installed onto and removed from the print system as a single unit. In this configuration the atomizer and head may be easily and rapidly replaced. Replacement may take place during normal maintenance or as a result of a catastrophic failure event such as a clogged nozzle. In this embodiment, the atomizer reservoir is preferably preloaded with feedstock such that the replacement unit is ready for use immediately upon installation. In a related embodiment, a cartridge-style unit allows rapid retooling of a print system. For example, a print head containing material A may quickly be exchanged for a print head containing material B. In these embodiments, the atomizer/head unit or cartridge are preferably engineered to be low cost, enabling them to be sold as consumables, which can be either disposable or refillable.

Figure 4:
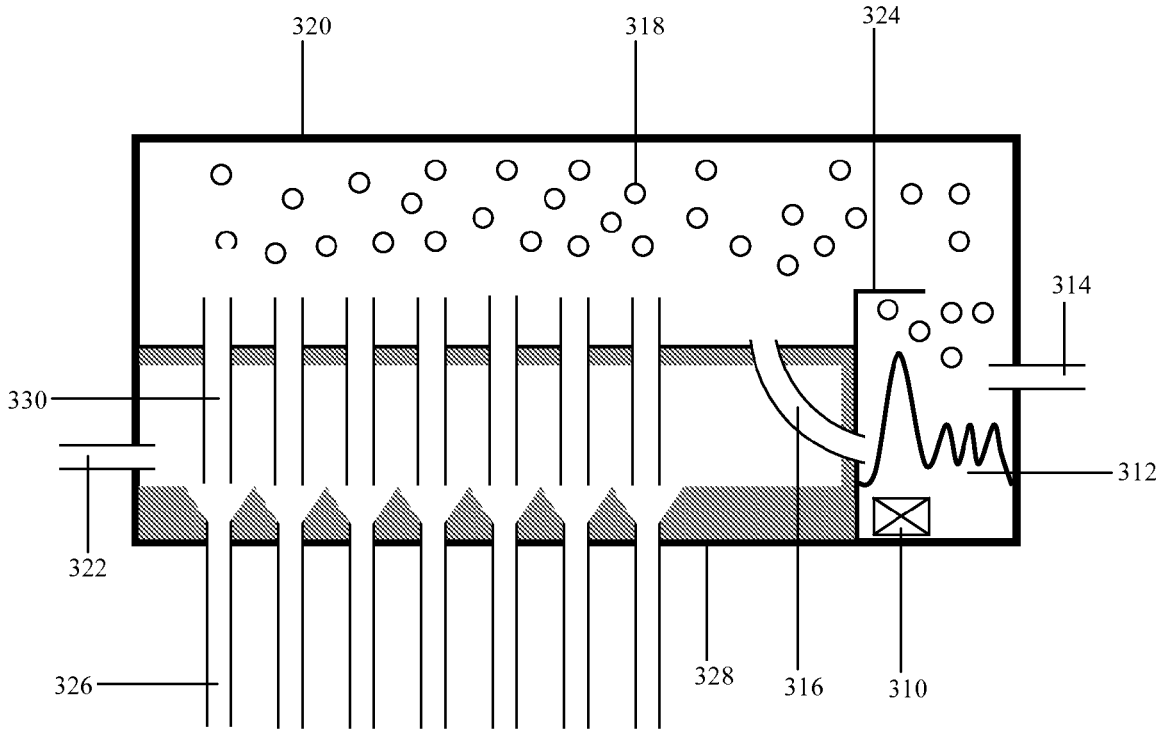
FIG. 4 is a cross-sectional schematic of a single apparatus integrating an atomizer, a deposition head, and a virtual impactor.

In one embodiment, the atomizer and deposition head are fully integrated into a single unit that shares structural elements, as shown in FIG. 4. This configuration is preferably the most compact and most closely represents the cartridge style-unit.

A virtual impactor is often used to remove the excess gas necessary for a pneumatic atomizer to operate, and thus is also integrated with the deposition head in the embodiments in which the atomizer is integrated. A heater, whose purpose is to heat the mist and drive off solvent, may also be incorporated into the apparatus. Elements necessary for maintenance of the feedstock in the atomizer, but not necessarily required for atomization, such as feedstock level control or low ink level warning, stirring and temperature controls, may optionally also be incorporated into the atomizer.

Other examples of elements that may be integrated with the apparatus generally relate to sensing and diagnostics. The motivation behind incorporating sensing elements directly into the apparatus is to improve response and accuracy. For example, pressure sensing may be incorporated into the deposition head. Pressure sensing provides important feedback about overall deposition head status; pressure that is higher than normal indicates that a nozzle has become clogged, while pressure that is lower than normal indicates that there is a leak in the system. By placing one or more pressure sensors directly in the deposition head, feedback is more rapid and more accurate. Mist sensing to determine the deposition rate of material might also be incorporated into the apparatus.

A typical aerosol jet system utilizes electronic mass flow controllers to meter gas at specific rates. Sheath gas and atomizer gas flow rates are typically different and may vary depending on the material feedstock and application. For a deposition head built for a specific purpose where adjustability is not needed, electronic mass flow controllers might be replaced by static restrictions. A static restriction of a certain size will only allow a certain amount of gas to pass through it for a given upstream pressure. By accurately controlling the upstream pressure to a predetermined level, static restrictions can be sized appropriately to replace the electronic mass flow controllers used for the sheath and atomizer gas. The mass flow controller for the virtual impactor exhaust can most easily be removed, provided that a vacuum pump is used, preferably capable of generating approximately 16 in Hg of vacuum. In this case, the restriction functions as a critical orifice. Integrating the static restrictions and other control elements in the deposition head reduces the number of gas lines that must run to the head. This is particularly useful for situations in which the head is moved rather than the substrate.

In any of the embodiments presented herein, whether or not the atomizer is integrated with the deposition head, the deposition head may comprise a single-nozzle or a multiple nozzle design, with any number of nozzles. A multi-jet array is comprised of one or more nozzles configured in any geometry.

FIG. 1 shows an embodiment of an ultrasonic atomizer integrated with an aerosol jet in a deposition head. Ink 12 is located in a reservoir adjacent to extended nozzle 25. Ultrasonic transducer 10 atomizes ink 12. Atomized ink 18 is then carried out of the reservoir by mist air or carrier gas entering through mist air inlet 14 and is directed around a shield 24 to an adjacent mist manifold, where it enters the mist delivery tube 30. Sheath gas enters sheath gas manifold 28 through sheath gas inlet 22. As the atomized ink travels through mist delivery tube 30, it is focused by the sheath air as it enters extended nozzle 25.

Figure 2:
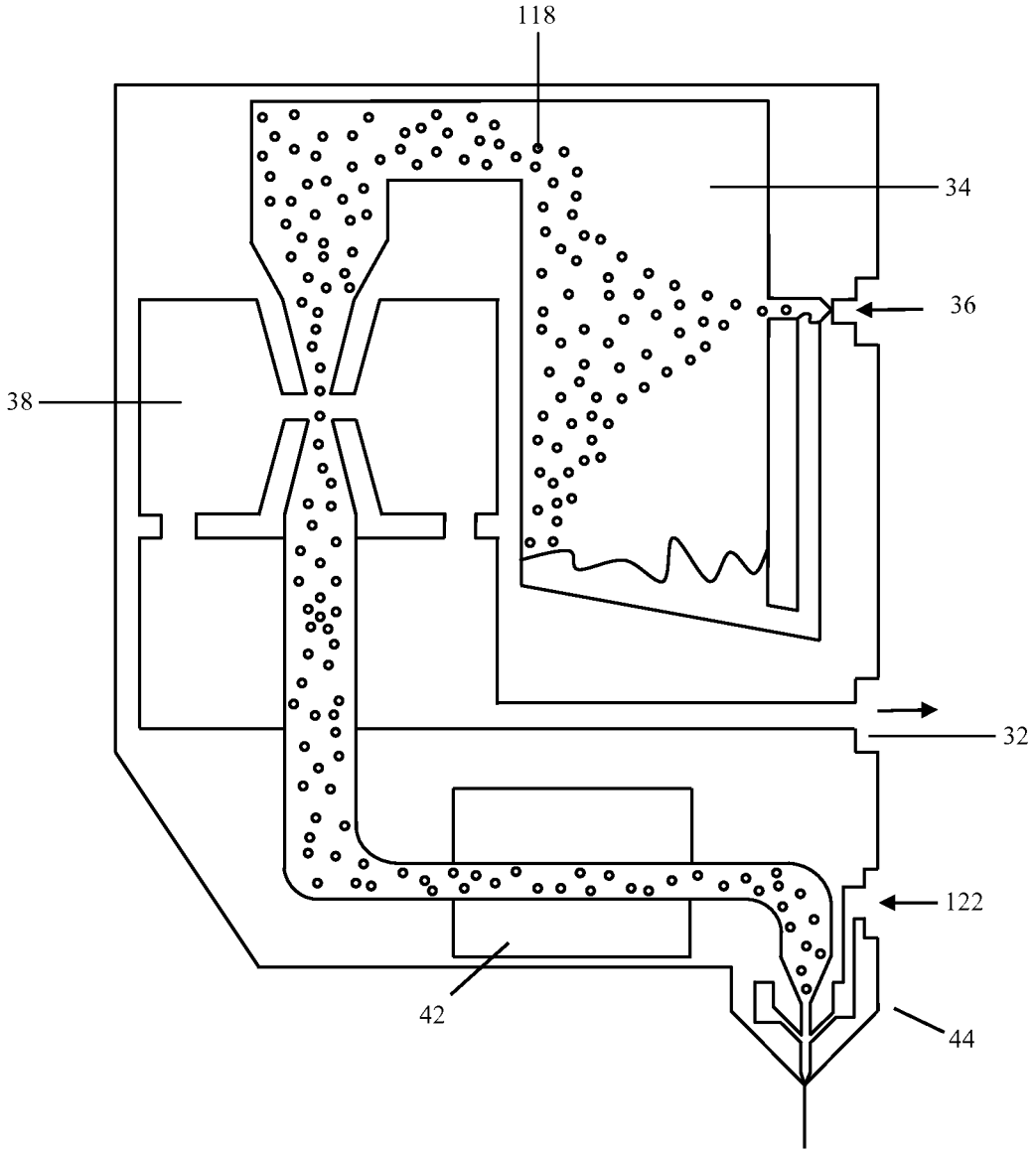
FIG. 2 is a schematic of a monolithic multi-nozzle deposition head with an atomizer.

FIG. 2 is an embodiment of an integrated pneumatic atomizing system with a single nozzle deposition head and virtual impactor. Atomization gas 36 enters ink reservoir 34 where it atomizes the ink and carries atomized ink 118 into virtual impactor 38. Atomization gas 36 is at least partially stripped and exits through the virtual impactor gas exhaust 32. Atomized ink 118 continues down through optional heater 42 and into deposition head 44. Sheath gas 122 enters the deposition head and focuses the atomized ink 118.

Figure 3:
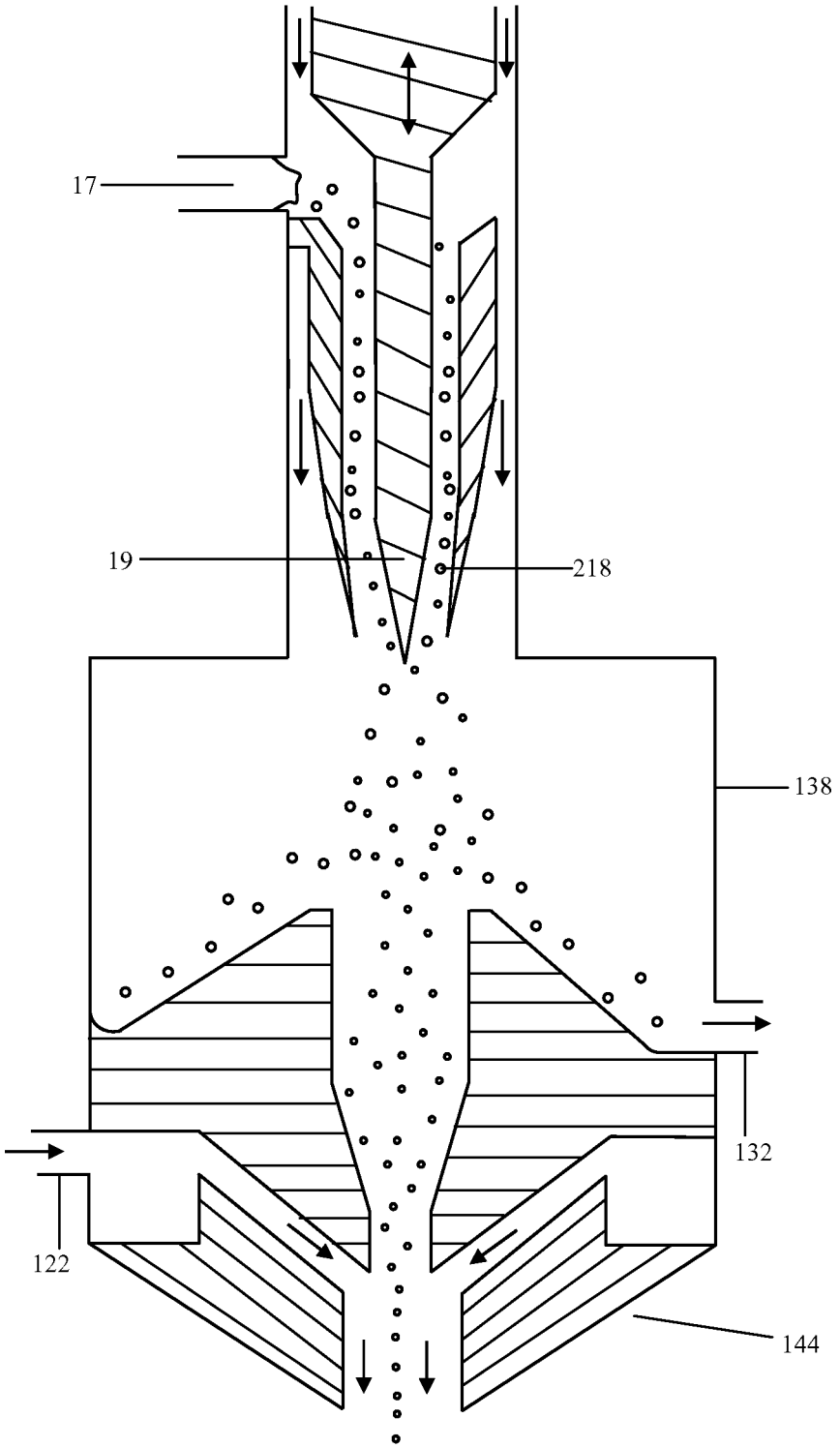
FIG. 3 is a schematic of an integrated atomizer with a single aerosol jet.

FIG. 3 is a cross-sectional schematic of an alternative embodiment of an integrated pneumatic atomizer, virtual impactor, and single nozzle deposition head. Plunger 19 that allows for adjustable flow rates is used to atomize ink entering from ink suspension inlet 17. Atomized ink 218 then travels to the adjacent virtual impactor 138. Exhaust gas exits the virtual impactor through exhaust gas outlet 132. Atomized ink 218 then travels to adjacent deposition head 144 where sheath gas 122 focuses the ink.

FIG. 4 shows an embodiment of a monolithic multi-nozzle aerosol jet deposition head with an integrated ultrasonic atomizer. Ink 312 is located in a reservoir preferably adjacent to nozzle array 326. Ultrasonic transducer 310 atomizes the ink. Atomized ink 318 is then carried out of the reservoir by mist air entering through the mist air inlet 314 and is directed around shield 324 to adjacent aerosol manifold 320, where it enters individual aerosol delivery tubes 330. Atomized ink 318 that does not enter into any of mist delivery tubes 330 is preferably recycled through drain tube 316 that empties back into the adjacent ink reservoir. Sheath gas enters sheath gas manifold 328 through sheath gas inlet 322. As atomized ink 318 travels through mist delivery tubes 330, it is focused by the sheath gas as it enters the nozzle array 326.

Figure 5:
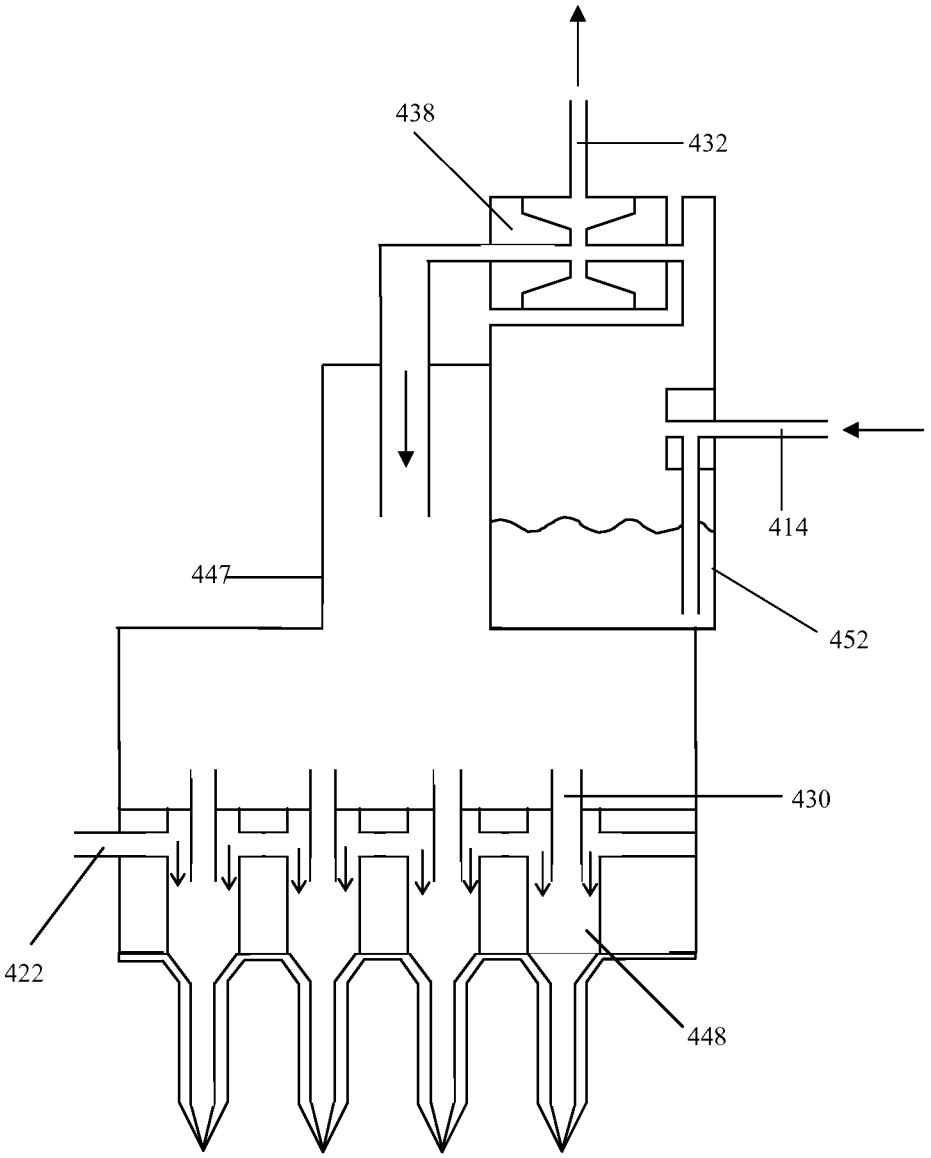
FIG. 5 is a schematic of an alternative embodiment of an integrated atomizing system with a deposition head and virtual impactor.

FIG. 5 is an embodiment of a multi-nozzle integrated pneumatic atomizing system with a deposition head that uses a manifold and a flow reduction device. Mist air enters the integrated system through mist air inlet 414 into pneumatic atomizer 452. The atomized material, which is entrained in the mist air to form an aerosol, then travels to adjacent virtual impactor 438. Exhaust gas exits the virtual impactor through exhaust gas outlet 432. The aerosol then travels to manifold inlet 447 and enters one or more sheath gas chambers 448 through one or more mist delivery tubes 430. Sheath gas enters the deposition head through gas inlet port 422, which is optionally oriented perpendicularly to mist delivery tubes 430, and combines with the aerosol flow at the bottom of mist delivery tubes 430. Mist delivery tubes 430 extend partially or fully to the bottom of sheath gas chambers 448, preferably forming a straight geometry. The length of sheath gas chambers 448 is preferably sufficiently long to ensure that the flow of the sheath gas is substantially parallel to the aerosol flow before the two combine, thereby generating a preferably cylindrically symmetric sheath gas pressure distribution. The sheath gas is then combined with the aerosol at or near the bottom of sheath gas chambers 448. Advantages to maintaining this straight region for combining the aerosol carrier gas with the sheath gas is that the sheath flow is fully developed and more evenly distributed around mist tubes 430 prior to combining with the mist, thus minimizing turbulence during the combining process, minimizing the sheath/mist mixing, reducing overspray, and resulting in tighter focusing. Further, "cross talk" between the nozzles in the array is minimized due to the individual sheath gas chambers 448.

The manifold may optionally be remotely located, or located on or within the deposition head. In either configuration, the manifold can be fed by one or more atomizers. In the pictured configuration, a single flow reduction device (virtual impactor) is used for a multi-jet array deposition head. In the event that a single stage of flow reduction is insufficient to remove enough excess carrier gas, multiple stages of reduction may be employed.

Multiple Atomizers

The apparatus may comprise one or more atomizers. Multiple atomizers of substantially the same design may be used to generate a greater quantity of mist for delivery from the deposition head, thereby increasing throughput for high-speed manufacturing. In this case, material of substantially the same composition preferably serves as feedstock for the multiple atomizers. Multiple atomizers may share a common feedstock chamber or optionally may utilize separate chambers. Separate chambers may be used to contain materials of differing composition, preventing the materials from mixing. In the case of multiple materials, the atomizers may run simultaneously, delivering the materials at a desired ratio. Any material may be used, such as an electronic material, an adhesive, a material precursor, or a biological material or biomaterial. The materials may differ in material composition, viscosity, solvent composition, suspending fluid, and many other physical, chemical, and material properties. The samples may also be miscible or non-miscible and may be reactive. In one example, materials such as a monomer and a catalyst may be kept separate until use to avoid reaction in the atomizer chamber. The materials are then preferably mixed at a specific ratio during deposition. In another example, materials with differing atomization characteristics may be atomized separately to optimize the atomization rate of the individual materials. For example, a suspension of glass particles may be atomized by one atomizer while a suspension of silver particles is atomized by a second atomizer. The ratio of glass to silver can be controlled in the final deposited trace.

The atomizers may alternatively run sequentially to deliver the materials individually, either in the same location or in differing locations. Deposition in the same location enables composite structures to be formed, whereas deposition in different areas enables multiple structures to be formed on the same layer of a substrate.

Figure 7:
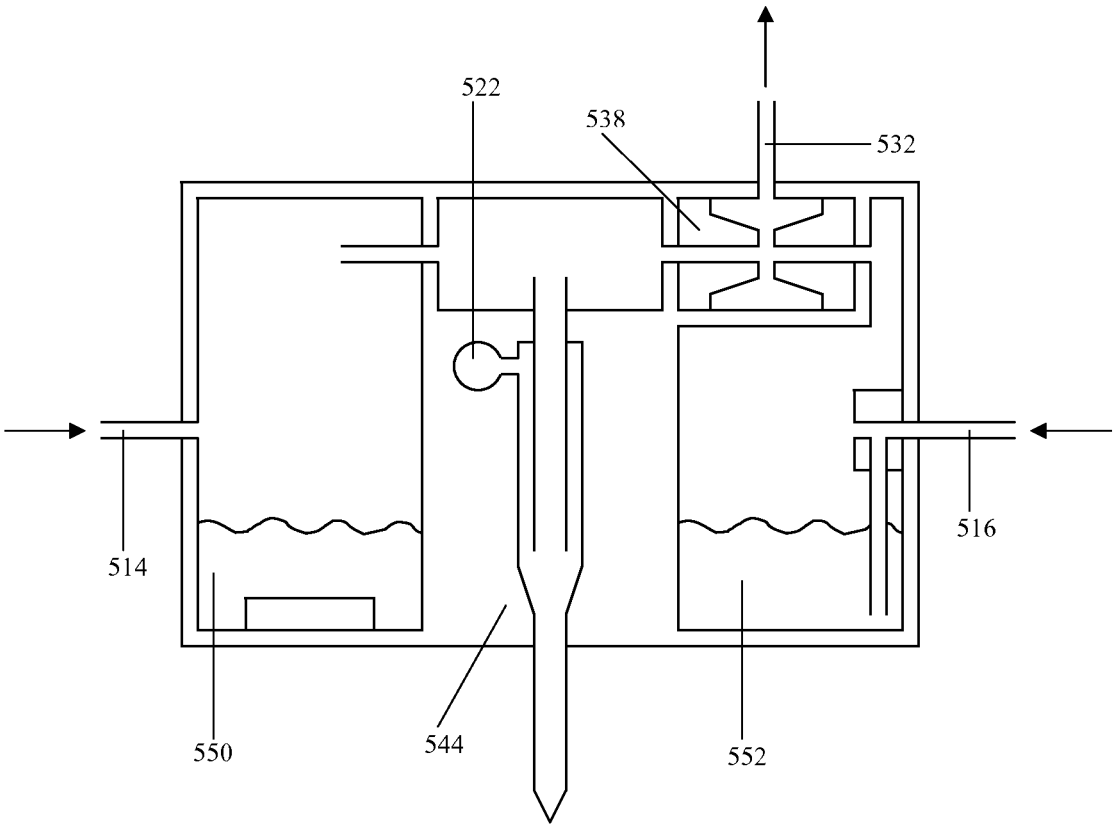
FIG. 7 is a schematic of multiple atomizers (one a pneumatic atomizer contained within one chamber and the other an ultrasonic atomizer contained within another chamber) integrated with the deposition head.

Optionally the atomizers may comprise different designs. For example, a pneumatic atomizer might be contained within one chamber and an ultrasonic atomizer might be contained in another chamber, as shown in FIG. 7. This allows the choice of atomizer to be optimized to match the atomization characteristics of the materials.

Figure 6:
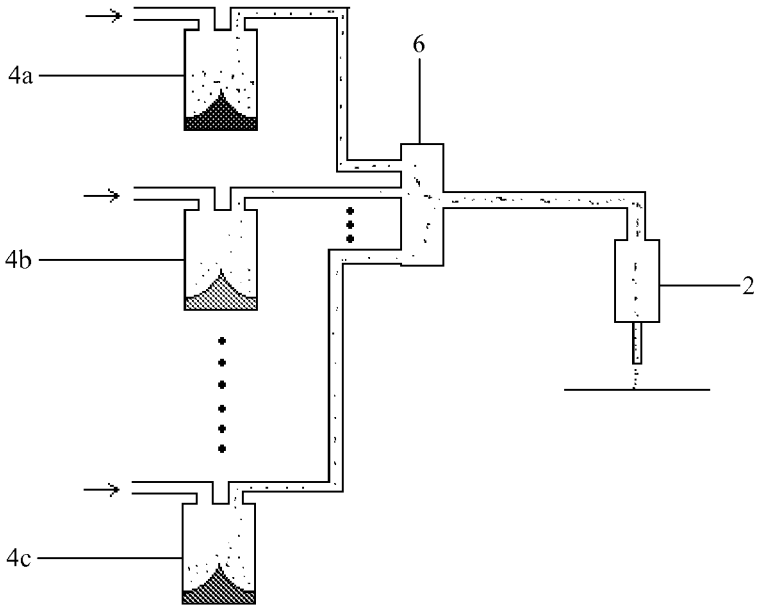
FIG. 6 is a schematic of another alternative embodiment of a multi-nozzle integrated atomizing system with a deposition head and a flow reduction device.

FIG. 6 depicts the $M^3D$® process used to simultaneously deposit multiple materials through a single deposition head. Each atomizer unit 4*a-c* creates droplets of its respective sample, and the droplets are preferably directed to combining chamber 6 by a carrier gas. The droplet streams merge in combining chamber 6 and are then directed to deposition head 2. The multiple types of sample droplets are then simultaneously deposited. The relative rates of deposition are preferably controlled by the carrier gas rate entering each atomizer 4*a-c*. The carrier gas rates can be continuously or intermittently varied.

Such gradient material fabrication allows continuum mixing ratios to be controlled by the carrier gas flow rates. This method also allows multiple atomizers and samples to be used at the same time. In addition, mixing occurs on the target and not in the sample vial or aerosol lines. This process can deposit various types of samples, including but not limited to: UV, thermosetting, or thermoplastic polymers; adhesives; solvents; etching compounds; metal inks; resistor, dielectric, and metal thick film pastes; proteins, enzymes, and other biomaterials; and oligonucleotides. Applications of gradient material fabrication include, but are not limited to: gradient optics, such as 3D grading of a refractive index; gradient fiber optics; alloy deposition; ceramic to metal junctions; blending resistor inks on-the-fly; combinatorial drug discovery; fabrication of continuum grey scale photographs; fabrication of continuum color photographs; gradient junctions for impedance matching in RF (radio frequency) circuits; chemical reactions on a target, such as selective etching of electronic features; DNA fabrication on a chip; and extending the shelf life of adhesive materials.

FIG. 7 shows the integration of multiple atomizers with the deposition head. On one side of the deposition head 544 is ultrasonic atomizer section 550 with mist air inlet 514. On the other side of deposition head 544 is pneumatic atomizer 552 with mist air inlet 516 and virtual impactor 538, with exhaust gas outlet 532. Sheath gas inlet 522 does not show the sheath gas path in the figure. While this embodiment is optimized to match the atomization characteristics of the materials, other combinations of multiple atomizers are possible, such as two or more ultrasonic atomizers; two or more pneumatic atomizers; or any combination thereof.

Non-integrated Atomizers or Components

There are situations in which it is not preferable to integrate the atomizer, or certain components, as a single unit with the deposition head. For example, the deposition head typically has the ability to print when oriented at an arbitrary angle to vertical. However, an atomizer may include a reservoir of fluid that must be maintained in a level position in order to function properly. Thus, in the case where the head is to be articulated, such an atomizer and head must not be connected rigidly, thereby enabling the atomizer to remain level during such articulation. One example of such a configuration is the case of such an atomizer and deposition head mounted onto the end of a robotic arm. In this example, the atomizer and deposition head assembly move together in x, y and z. However, the apparatus is configured such that only the deposition head is free to tilt to an arbitrary angle. Such a configuration is useful for printing in three dimensional space, such as onto the exterior, interior, or underside of structures, including but not limited to large structures such as airframes.

In another example of a closely coupled but not fully integrated atomizer and print head, the combined unit is arranged such that the deposition head can extend into a narrow passage.

While in certain configurations the mist-generating portion of the atomizer is located adjacent to the deposition head, non mist-generating portions of the atomizer may optionally be located remotely. For example, the driver circuit for an ultrasonic atomizer might be located remotely and not integrated into the apparatus. A reservoir for the material feedstock might also be remotely located. A remotely located reservoir might be used to refill the local reservoir associated with the deposition head to enable a longer period of operation without user maintenance. A remotely located reservoir can also be used to maintain the feedstock at a particular condition, for example to refrigerate a temperature-sensitive fluid until use. Other forms of maintenance may be performed remotely, such as viscosity adjustment, composition adjustment or sonication to prevent agglomeration of particulates. The feedstock may flow in only one direction, e.g. to resupply the local ink reservoir from the remotely located reservoir, or may alternatively be returned from the local ink reservoir to the remote reservoir for maintenance or storage purposes.

Materials

The present invention is able to deposit liquids, solutions, and liquid-particle suspensions. Combinations of these, such as a liquid-particle suspension that also contains one or more solutes, may also be deposited. Liquid materials are preferred, but dry material may also be deposited in the case where a liquid carrier is used to facilitate atomization but is subsequently removed through a drying step.

Reference to both ultrasonic and pneumatic atomization methods has been made herein While either of these two methods may be applicable for atomizing fluids having only a specific range of properties, the materials that may be utilized by the present invention are not restricted by these two atomization methods. In the case where one of the aforementioned atomization methods is inappropriate for a particular material, a different atomization method may be selected and incorporated into the invention. Also, practice of the present invention does not depend on a specific liquid vehicle or formulation; a wide variety of material sources may be employed.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A method for depositing multiple materials on a target, the method comprising the steps of:

atomizing a first material to form a first aerosol comprising first droplets, the first droplets comprising the first material;

atomizing a second material different from the first material to form a second aerosol comprising second droplets, the second droplets comprising the second material;

merging a first droplet stream comprising the first aerosol and a second droplet stream comprising the second aerosol to form a merged droplet stream, the merged droplet stream comprising the first droplets and the second droplets such that the first droplets and the second droplets are transported together without reacting the first material with the second material;

surrounding the merged droplet stream with an annular flow of a sheath gas in a generally conical region, thereby forming a combined stream;

focusing the combined stream;

transporting the combined stream through a nozzle; and depositing the first and second droplets on a target;

wherein the first and second materials do not react until they are deposited on the target; and wherein the conical region is oriented to converge the combined stream toward a central axis of the apparatus prior to the depositing step.

2. The method of claim 1, wherein the atomizing steps are performed simultaneously, thereby delivering the materials to the target at a desired ratio.

3. The method of claim 1, further comprising combining the first aerosol and second aerosol in a combining chamber prior to the surrounding step, wherein the first aerosol and the second aerosol enter the combining chamber from different directions.

4. The method of claim 1, further comprising separately atomizing each material.

5. The method of claim 4, further comprising optimizing the atomization rate of each material.

6. The method of claim 1, further comprising the step of varying the amount of material in at least one of the aerosols.

7. The method of claim 1, wherein the atomizing steps comprise using atomizers of a different design for each material or using atomizers of a same design for each material.

8. The method of claim 7, further comprising controlling the relative rates of deposition of the materials by varying a carrier gas flow rate entering each atomizer.

9. The method of claim 8, further comprising continuously or intermittently varying the carrier gas flow rates.

10. The method of claim 8, further comprising controlling continuum mixing ratios by varying the carrier gas flow rates.

11. The method of claim 1, wherein at least one of the materials is selected from the group consisting of UV, thermosetting, or thermoplastic polymers, adhesives, solvents, etching compounds, metal inks, resistor, dielectric, and metal thick film pastes, proteins, enzymes, and other biomaterials, and oligonucleotides.

12. The method of claim 1, wherein the depositing step comprises forming a gradient material structure.

13. The method of claim 12, wherein the gradient structure is used for an application selected from the group consisting of gradient optics, 3D grading of a refractive index, gradient fiber optics, alloy deposition, ceramic to metal junctions, blending resistor inks on-the-fly, combinatorial drug discovery, fabrication of continuum grey scale photographs, fabrication of continuum color photographs, gradient junctions for impedance matching in RF (radio frequency) circuits, chemical reactions on a target, selective etching of electronic features, DNA fabrication on a chip, and extending the shelf life of adhesive materials.

14. An apparatus for depositing multiple materials, the apparatus comprising:

a first chamber for containing a first material;

a second chamber for containing a second material;

a first atomizer for atomizing the first material to form a first aerosol;

a second atomizer for atomizing the second material to form a second aerosol;

a combining chamber for combining a first droplet stream comprising the first aerosol and a second droplet stream comprising the second aerosol to form a merged droplet stream without reacting the first material with the second material;

a generally conical region for surrounding and focusing the merged droplet stream with a sheath gas, thereby forming a combined stream;

a nozzle for transporting said combined stream; and a material deposition outlet;

said conical region oriented to converge said combined stream toward a central axis of the apparatus prior to said material deposition outlet.

15. The apparatus of claim 14, wherein the first and second atomizers comprise different designs.

16. The apparatus of claim 14, wherein at least one of the atomizers is selected from the group consisting of ultrasonic atomizer and pneumatic atomizer.

17. The apparatus of claim 14, wherein each atomizer is selected to optimally match the atomization characteristics of the corresponding material.

18. The apparatus of claim 14, wherein said combining chamber is connected to said first atomizer via a first passage and said combining chamber is connected to said second atomizer via a second passage, said passages configured such that the first aerosol and the second aerosol enter said combining chamber from different directions.

19. The apparatus of claim 15, wherein at least one of the aerosols enters and exits said combining chamber from the same direction.

20. A method for depositing multiple materials on a target, the method comprising the steps of:

atomizing a first material to form a first aerosol;

surrounding and focusing the first aerosol with an annular flow of a sheath gas in a generally conical region to form a first combined stream;

transporting the first combined stream through a nozzle;

depositing the first aerosol on a target;

atomizing a second material to form a second aerosol;

surrounding and focusing the second aerosol with the annular flow of a sheath gas in a generally conical region to form a second combined stream;

transporting the second combined stream through a nozzle; and depositing the second aerosol on the target;

wherein the first and second materials do not mix or react until they are deposited on the target; and wherein the conical region is oriented to converge each combined stream toward a central axis of the apparatus prior to the corresponding depositing step.

21. The method of claim 20, wherein the atomizing steps are performed sequentially.

22. The method of claim 20, wherein the first and second materials are deposited at the same location on the target, thereby forming a composite structure.

23. The method of claim 20, wherein the first and second materials are deposited at different locations on the target, thereby forming multiple structures on a same layer of the target.

* * * * *